United States Patent [19]

Dahl et al.

[11] Patent Number: 4,556,454

[45] Date of Patent: Dec. 3, 1985

[54] WET PRESS FOR DEWATERING A WEB OF MATERIAL

[75] Inventors: Hans Dahl; Herbert Holik, both of Ravensburg; Rüdiger Kurtz, Immenstaad; Wolf-Gunter Stotz, Ravensburg, all of Fed. Rep. of Germany

[73] Assignee: Sulzer-Escher Wyss GmbH, Ravensburg, Fed. Rep. of Germany

[21] Appl. No.: 695,853

[22] Filed: Jan. 28, 1985

[30] Foreign Application Priority Data

Feb. 6, 1984 [CH] Switzerland ..... 533/84

[51] Int. Cl.[4] ..... D21F 3/02

[52] U.S. Cl. ..... 162/358; 29/116 AD; 100/118; 100/153; 162/361

[58] Field of Search ..... 162/358, 360.1, 361, 162/205, 305; 29/113 AD, 116 AD; 100/118, 153, 154, 162 B

[56] References Cited

U.S. PATENT DOCUMENTS 3,783,097 1/1974 Justus ..... 162/358
3,802,044 4/1974 Spillman et al. ..... 29/113 AD
4,058,878 11/1977 Lehmann ..... 29/116 AD
4,228,571 10/1980 Biondetti ..... 29/116 AD

FOREIGN PATENT DOCUMENTS 1172887 8/1984 Canada ..... 162/358

*Primary Examiner*—S. Leon Bashore
*Assistant Examiner*—K. M. Hastings
*Attorney, Agent, or Firm*—Werner W. Kleeman

[57] ABSTRACT

In a wet press for dewatering a web of material, for instance a web of paper, a contact pressure device presses against a rotating roll and exerts a pressure which increases in the travel direction of the web of paper. For this purpose, several rows of contact pressure elements are arranged sequentially in the travel direction of the web of paper. In each row the contact pressure elements are arranged side by side transversely to the travel direction of the web of paper. In order to circumvent a differential dewatering at the location of the contact pressure elements and at the gaps between the contact pressure elements of a row, the contact pressure elements of successive rows are shifted or staggered in relation to one another transversely to the web of material such that they mutually overlap. This prevents the arisal of strips in the paper being processed.

12 Claims, 5 Drawing Figures

WET PRESS FOR DEWATERING A WEB OF MATERIAL

CROSS REFERENCE TO RELATED APPLICATION

This application is related to the commonly assigned, co-pending U.S. patent application Ser. No. 06/695,854, filed Jan. 29, 1985, and entitled "WET PRESS FOR DEWATERING A MATERIAL WEB".

BACKGROUND OF THE INVENTION

The present invention broadly relates to a wet press and, more specifically, pertains to a new and improved construction of a wet press for dewatering a web of material.

Generally speaking, the wet press of the present invention comprises a rotating roll and a contact pressure device between which the web of material is guided in a press nip together with at least one water-absorbent belt along a portion of the circumference of the rotating roll. The contact pressure device comprises at least two contact pressure elements sequentially arranged in the direction of travel of the web of material which exert a pressing force which increases in such direction of travel of the web of material.

In other words, the wet press for dewatering a web of material comprises a rotating roll having a circumference, a contact pressure device and at least one water-absorbent belt. The contact pressure device and the rotating roll define a press nip therebetween. The web of material is guided conjointly with the water-absorbent belt between the contact pressure device and the rotating roll through the press nip and along a portion of the circumference of the rotating roll. The web of material has a predetermined direction of travel. The contact pressure device comprises at least two contact pressure elements arranged sequentially in the direction of web travel for exerting a contact pressure which increases in such direction of web travel.

Such wet presses are described, for instance, in the U.S. Pat. No. 3,783,097, granted Jan. 1, 1974 or the German Pat. No. 3,105,276 and serve for dewatering, for instance, a web of paper or pulp or another fibrous material. The web of material is guided through a press nip together with, for instance, a water-absorbent felt belt and a water-impervious pressure belt. The press nip is formed by a roll and several contact pressure elements arranged sequentially in the direction of travel of the web of material. In order to achieve a good dewatering effect, the pressing force of the sequentially arranged contact pressure elements increases in the direction of web travel up to a maximum value and then is reduced to zero as suddenly as possible in order to avoid a re-moistening.

The contact pressure elements can be constructed as pressure ledges or beams extending over the entire width of the web of material. As the roll deflects in operation there is no guarantee that the contact pressure devices will exert the same pressure over the entire width of the web of material. It can also be desirable to vary the pressure exerted on the web of material over the width of the web of material. With contact pressure elements constructed as ledges which are continuous over the entire web width, this is, however, difficult. In order to be able to regulate a contact pressure or pressing force uniformly over the roll width or to regulate a desired pressure profile, the contact pressure elements must be divided into a number of individual pressure or support elements arranged adjacent to one another in a row transverse to the direction of travel of the web of material. Even if the individual pressure or support elements are arranged in intimate contact over the roll width, a pressure gradient necessarily arises at the border between two adjacent pressure elements which leads to a non-uniform dewatering over the width of the web of material and, for instance, can result in stripes in the fabricated paper which are intolerable or hardly tolerable in practice.

SUMMARY OF THE INVENTION

Therefore, with the foregoing in mind, it is a primary object of the present invention to provide a new and improved construction of a wet press for dewatering a web of material which does not exhibit the aforementioned drawbacks and shortcomings of the prior art constructions.

Another and more specific object of the present invention aims at providing a new and improved construction of a wet press of the previously mentioned type in which a uniform dewatering of a web of material over its entire width is attainable, in which a uniform pressure or a desired pressure profile over the entire web width is attainable and in which detrimental or undesired effects of a deflection of the roll in operation are obviated while a contact pressure or pressing force which increases in the direction of travel of the web of material is retained.

Yet a further significant object of the present invention aims at providing a new and improved construction of a wet press of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the wet press of the present invention is manifested by the features that the contact pressure device comprises at least two rows of contact pressure elements arranged sequentially in the direction of web travel. In each row, several contact pressure elements are arranged adjacent to one another transversely to the direction of travel of the web of material such that the contact pressure elements of one row are shifted or staggered in relation to the contact pressure elements of another row.

In other words, the wet press of the present invention is manifested by the features that the contact pressure device comprises at least two rows of contact pressure elements arranged sequentially in the direction of web travel and in each such row a plurality of the contact pressure elements is arranged in mutually adjacent relationship in a direction extending substantially transverse to the direction of travel of the web of material such that the contact pressure elements of one row are transversely shifted in relation to the contact pressure elements of at least one further row.

The division or distribution of the contact pressure elements of each zone or row into several mutually adjacent pressure elements permits adapting the pressing force to the deflection of the rotating roll. A stripedness of the web of material or of the paper is avoided by the shifted or staggered arrangement of the individual pressure elements of the different rows. Since successive rows of pressure elements exert an increasing pressing force, the advantages of dewatering with successively increasing pressure are retained.

The individual pressure elements can advantageously be constructed as hydrostatic pressure or support elements comprising a piston movable in the pressing direction within a pressure chamber provided with pressure medium. The piston carries a pressure member provided with pressure pockets or recesses. The pressure pockets or recesses are in communication with the pressure chamber through channels or conduits. Thus a uniform pressing force of all pressure elements over the entire width is ensured in particularly simple manner or, alternatively, a desired pressure profile can be regulated.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
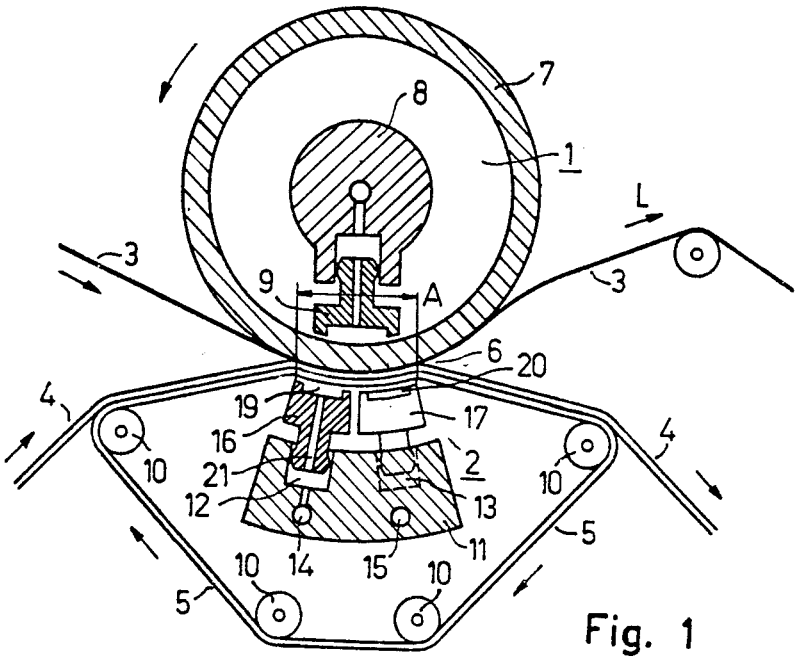
FIG. 1 schematically shows a wet press according to the invention in longitudinal section.

Describing now the drawings, it is to be understood that to simplify the showing thereof only enough of the structure of the wet press has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a rotating roll 1 and a contact pressure device 2 between which the web of material, for instance a paper web 3, is guided conjointly with a water-absorbent belt 4, for instance a felt belt, and a flexible, water-impervious, contact pressure belt 5 in a press nip 6 along a portion A of the circumference of rotating the roll 1. During the passage of the web of paper 3 through this press nip 6, the dewatering of the paper web 3 is effected with successively increasing pressing force and the water expressed from the paper web 3 is absorbed by the water-absorbent felt belt 4. If necessary further belts, for instance a sieve belt, can be additionally guided through the press nip 6.

The rotating or rotatable roll 1 can be constructed as a solid roll, a tubular roll or a suction roll. The rotating roll 1 can also be constructed as a deflection or sag compensation roll or as a controlled deflection roll as illustrated in FIG. 1. As a controlled deflection roll, the rotating roll 1 comprises a rotating roll shell 7 and a stationary roll support or beam 8. Both components are supported against one another by contact pressure elements 9 movable in the pressing direction, so that the deflection or sag of the rotating rotating roll 1 is regulatable. The contact pressure elements 9 can be constructed in any conventional manner. Hydrostatic pressure elements, such as are disclosed in the U.S. Pat. No. 3,802,044, granted Apr. 9, 1974, have proven to be particularly suitable. A plurality of such pressure elements 9 is arranged in mutually adjacent relationship in the axial direction of the rotating roll 1, i.e. transverse to the direction of extent of the paper web 3.

The contact pressure belt 5 can be constructed as a continuous belt and runs over several guide rolls 10 with the paper web 3 and the water-absorbent felt belt 4 through the press nip 6. The contact pressure belt 5 can also possibly be constructed in the form of a roll shell, so that guide rolls may be foregone. In this case, however, a sufficient flexibility of this roll shell must be ensured.

The contact pressure device 2 comprises a transverse support or beam 11 including two rows of pressure chambers 12 and 13. These two rows of pressure chambers 12 and 13 are arranged sequentially in the direction of travel of the web of material. The pressure chambers 12 and 13 are supplied with a suitable pressure medium through conduits 14 and 15. Contact pressure elements 16 and 17 are installed in these pressure chambers 12 and 13 in transversely adjacent relationship relative to the web travel direction. The contact pressure elements 16 and 17 are pressed against the rotating roll 1 by the pressure prevailing in the cylindrical pressure chambers 12 and 13 and dewater the paper web 3 by their contact pressure or pressing force.

These contact pressure elements 16 and 17 can, in principal, be constructed in any suitable form. However, their construction as hydrostatic pressure elements according to the aforementioned U.S. Pat. No. 3,802,044 has proven to be particularly advantageous. In this construction, the contact pressure elements 16 and 17 comprise pressure pockets or recesses 19 and 20 on their pressing surfaces which communicate with the pressure chambers 12 and 13 through conduits or bores 21. The contact pressure or pressing force of the contact pressure elements 16 and 17 is designed such that the pressing force in the direction of travel of the paper web 3 successively increases, i.e. the pressing force of the contact pressure elements 17 is greater than that of the contact pressure elements 16. This can be achieved in various manners, for instance by making the pressure in the cylindrical pressure chamber 13 greater than that in the cylindrical pressure chamber 12, by making the cross-sectional area of the bores 21 of the contact pressure elements 16 and 17 different or by making the effective pressure area of the contact pressure element 17 smaller than the effective pressure area of the contact pressure element 16 or by making the cross sections of the pressure chambers 13 of the contact pressure elements 17 greater than those of the contact pressure elements 16. If necessary, a combination of the above measures is also possible.

It will be understood that not only two rows of contact pressure elements 16 and 17 can be provided as illustrated in FIG. 1, but that a greater number of contact pressure element rows is also possible and that the contact pressure or pressing force successively increases from row to row in the direction of travel of the paper web 3 until it suddenly drops at the last row of contact pressure elements. The individual rows of contact pressure elements are advantageously provided in sequence as close as possible to one another in order to avoid a re-moistening of the paper web 3 between such individual rows of contact pressure elements. In this manner, a particularly good dewatering of the web of material is achieved by employing a successively increasing contact pressure or pressing force.

Figure 2:
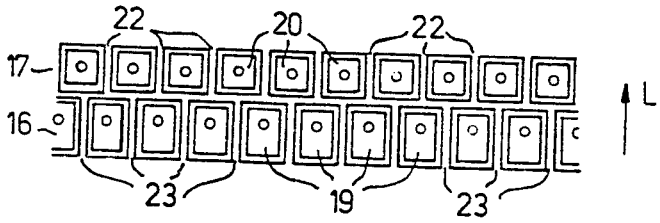
FIG. 2 schematically shows a first embodiment of contact pressure device in plan view.

The contact pressure device 2 described above with reference to the cross section of FIG. 1 is illustrated in FIG. 2 in plan view. Two rows of contact pressure elements 16 and 17 are arranged sequentially in the direction of web travel. The individual contact pressure elements 16 and 17 of each row are arranged in intimate contact in the transverse direction so that only narrow gaps 22 and 23 exist between mutually adjacent contact pressure elements 16, respectively 17. In order to achieve a contact pressure or pressing force which increases in the direction of web travel, the effective pressure areas of the pressure pockets or recesses 20 of the row of contact pressure elements 17 which is rearmost in the direction of web travel are made somewhat smaller than the effective pressure areas of the pressure pockets or recesses 19 of the row of contact pressure elements 16 which is foremost in the direction of web travel.

As seen in the transverse direction in relation to the travel direction of the web 3, the contact pressure or pressing force exerted in each row of contact pressure elements drops off between the individual adjoining contact pressure elements 16, respectively 17, so that the dewatering in the inevitable interstices between the individual contact pressure elements is lower than in the region of the pressure pockets or recesses 19 and 20. This generally leads to an undesirable stripedness of the fabricated paper. In order to avoid this effect, the contact pressure elements 16 and 17 of both rows are mutually shifted or staggered and overlap one another in their transverse extent. The gaps 22 of the rearmost row of contact elements 17 therefore lie at those locations where pressure pockets or recesses 19 are situated in the forward row of contact pressure elements 16 as seen in the direction of web travel. Conversely the gaps 23 between the contact pressure elements 16 of the forward row are provided exactly at those locations where pressure pockets or recesses 20 are present in the rearmost row of contact pressure elements 17 when regarded in the direction of web travel.

Figure 3:
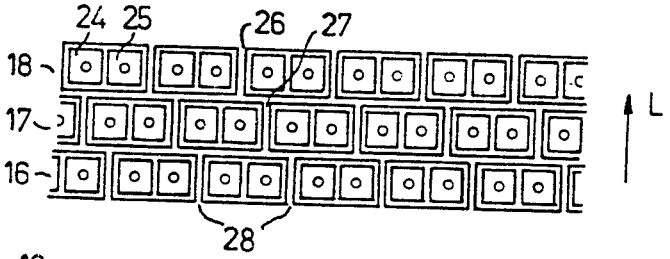
FIG. 3 schematically shows a further embodiment of contact pressure device in plan view.

FIG. 3 shows a plan view of a contact pressure device in which three rows of contact pressure elements 16, 17 and 18 are provided. These contact pressure elements 16, 17 and 18 are each provided with a pair of pressure pockets 24 and 25 instead of a single pressure pocket 19 or 20 as in the preceding example. This improves transverse stability. The individual contact pressure elements 16, 17 and 18 can also be provided with a plurality of pressure pockets or recesses arranged sequentially in the direction of web travel for the purposes of improving stability. These pressure pockets or recesses 24 and 25 may be connected with the same pressure chamber 12 or 14 by separate conduits or bores. Furthermore, the contact pressure elements of the individual rows are arranged close together in the transverse direction, so that only narrow gaps or interstices 26, 27 and 28 arise between the individual contact pressure elements 16, 17 and 18. These gaps or interstices 26, 27 and 28 are furthermore shifted in relation to one another such that the contact pressure elements 16, 17 and 18 of the various rows overlap in their transverse extent. Furthermore, the contact pressure or pressing force once again increases in the direction of web travel from row to row, i.e. it successively increases from the row of contact pressure elements 16 to the row of contact pressure elements 17 and the row of contact pressure elements 18. In this manner, i.e. with three or an even greater number of rows of contact pressure elements, an even better uniformity of the paper or the like being fabricated can be attained. A greater number of rows of contact pressure elements permits increasing the contact pressure or pressing force in finer steps, which reduces the danger of damaging the web of paper 3 by crushing.

Figure 4:
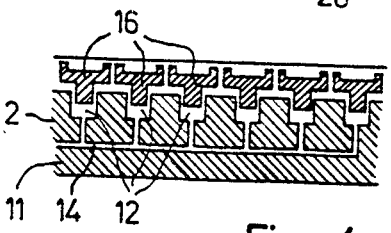
FIG. 4 schematically shows in cross section a contact pressure device with common regulating means.

FIG. 4 shows a contact pressure device 2 in cross section. A row of contact pressure elements 16 is provided in the transverse roll support or beam 11 arranged in mutual adjacency in the transverse direction. The contact pressure elements 16 are movable in cylindrical pressure chambers 12 in the direction of the pressing force. The individual pressure chambers 12 are connected to a source of pressure medium by means of a common conduit 14 and are therefore supplied with pressure medium at uniform pressure. In this manner a contact pressure or pressing force which is constant in the transverse direction along the rows of contact pressure elements 16, 17 and 18 is attained.

Figure 5:
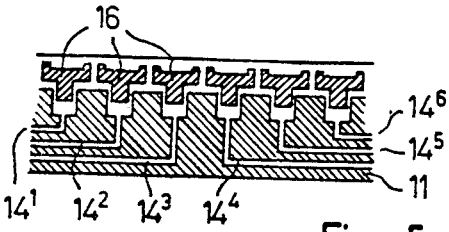
FIG. 5 schematically shows a further contact pressure device in cross section.

As shown in FIG. 5, it can also be advantageous to connect the individual contact pressure elements 16, 17 and 18 to individual conduits $14^1$, $14^2$ . . . $14^6$ and to supply them with a pressure medium of varying pressure. Several pressure chambers 12 can also be connected to a single conduit in groups, so that the pressure can be controlled in zones. In this manner, a predetermined pressure profile and a corresponding moisture profile of the paper web 3 being fabricated can be regulated in the transverse direction along the row of contact pressure elements 16, 17 and 18. This may be desirable under certain conditions.

It will be understood that the invention is not limited to the illustrative embodiments disclosed. Modifications within the framework and teachings of the inventive concepts are possible. For instance, in the spirit of the invention a roll is to be understood not only as a relatively rigid, solid roll or as a more or less rigid hollow roll supported in its interior by any desired construction of support elements or rollers, but also as a relatively flexible or belt-like roll jacket or sleeve also suitably supported in its interior. The surface of the contact pressure elements or the pressure pockets or recesses can advantageously be rhombic or trapezoidal instead of square or rectangular and thereby further improve the uniformity of the web of material.

While there are shown and described present preferred embodiments of the invention, it is to be distinctly understood that the invention is not limited thereto, but may be otherwise variously embodied and practiced within the scope of the following claims.

Accordingly, what we claim is:

1. A wet press for dewatering a web of material, comprising:

a rotating roll having a circumference;

a contact pressure device;

said contact pressure device and said rotating roll defining therebetween a press nip;

at least one water-absorbent belt;

the web of material being guided conjointly with said at least one water-absorbent belt between said contact pressure device and said rotating roll through said press nip and along a portion of said circumference of said rotating roll;

the web of material having a predetermined direction of travel;

said contact device comprising at least two substantially transverse rows of contact pressure elements arranged sequentially in said predetermined direction of travel; and a plurality of said contact pressure elements in each row being arranged in adjacent relationship in a direction substantially transverse to said predetermined direction of travel such that said contact pressure elements of one row of said at least two rows are transversely shifted in relation to said contact pressure elements of at least one further row of said at least two rows.

2. The wet press as defined in claim 1, further including:

a flexible water-impervious, continuous belt guided between said water-absorbent belt and said contact pressure device.

3. The wet press as defined in claim 2, further including:

deflection rolls; and said flexible, water-impervious, continuous belt being guided over said deflection rolls.

4. The wet press as defined in claim 1, wherein:

said contact pressure device comprises substantially cylindrical pressure chambers supplied with a pressure medium;

said contact pressure elements being constructed as hydrostatic support elements having a direction of contact pressure;

each contact pressure element of said contact pressure elements being movable in a respective one of said substantially cylindrical pressure chambers in said direction of contact pressure;

said contact pressure elements each comprising at least one pressure pocket; and respective bores connecting each said at least one pressure pocket with an associated one of said substantially cylindrical pressure chambers.

5. The wet press as defined in claim 4, wherein:

said pressure medium supplied to said substantially cylindrical pressure chambers of said one row has a first predetermined pressure;

said pressure medium supplied to said substantially cylindrical pressure chambers of said at least one further row having a second predetermined pressure;

said one row preceding said at least one further row in said predetermined direction of travel; and said second predetermined pressure being greater than said first predetermined pressure.

6. The wet press as defined in claim 4, wherein:

said bores connecting each said at least one pressure pocket with each said substantially cylindrical pressure chamber of said one row having a first predetermined cross-sectional area;

said bores connecting each said at least one pressure pocket with each said substantially cylindrical pressure chamber of said at least one further row having a second predetermined cross-sectional area;

said one row preceding said at least one further row in said predetermined direction of travel; and said second cross-sectional area being greater than said first cross-sectional area.

7. The wet press as defined in claim 4, wherein:

said pressure pockets of said one row of contact pressure elements each have a first predetermined effective pressure area;

said pressure pockets of said at least one further row of contact pressure elements each have a second predetermined effective pressure area;

said one row preceding said at least one further row in said predetermined direction of travel; and said second predetermined effective pressure area being less than said first predetermined effective pressure area.

8. The wet press as defined in claim 4, wherein:

said substantially cylindrical pressure chambers of said one row of contact pressure elements each have a first predetermined cross-sectional area;

said substantially cylindrical pressure chambers of said at least one further row of contact pressure elements each have a second predetermined cross-sectional area;

said one row preceding said at least one further row in said predetermined direction of travel; and said second predetermined cross-sectional area being greater than said first predetermined cross-sectional area.

9. The wet press as defined in claim 1, wherein:

said contact pressure device comprises more than two transverse rows of said contact pressure elements arranged sequentially in said predetermined direction of travel;

said contact pressure elements being arranged in each of said more than two rows with interstices therebetween; and said interstices of each of said more than two rows being arranged in said direction substantially transverse to said predetermined direction of travel such that said interstices in each row of said more than two rows have a transverse position different from transverse positions of said interstices in all other rows of said more than two rows.

10. The wet press as defined in claim 4, further including:

a pressure conduit connected to all of said substantially cylindrical pressure chambers of said contact pressure elements of at least one row of said at least two rows for supplying pressure medium conjointly to all of said substantially cylindrical pressure chambers of said contact pressure elements of said at least one row.

11. The wet press as defined in claim 4, further including:

a plurality of mutually distinct pressure conduits individually connected with associated ones of said substantially cylindrical pressure chambers of at least one row of said at least two rows.

12. The wet press as defined in claim 4, further including:

a plurality of mutually distinct pressure conduits connected with associated groups of said substantially cylindrical pressure chambers of at least one row of said at least two rows.

* * * * *